US011821718B2

(12) United States Patent
Beal

(10) Patent No.: US 11,821,718 B2
(45) Date of Patent: Nov. 21, 2023

(54) METHOD OF PRODUCING PLATED POWDER-CORE PROJECTILE

(71) Applicant: Lone Star Future Weapons, LLC, Garland, TX (US)

(72) Inventor: Harold F. Beal, University Park, TX (US)

(73) Assignee: TRUE VELOCITY IP HOLDINGS, LLC, Garland, TX (US)

( * ) Notice: Subject to any disclaimer, the term of this patent is extended or adjusted under 35 U.S.C. 154(b) by 226 days.

(21) Appl. No.: 17/467,520

(22) Filed: Sep. 7, 2021

(65) Prior Publication Data

US 2023/0070206 A1 Mar. 9, 2023

(51) Int. Cl.

| | |
|---|---|
| ***F42B 33/00*** | (2006.01) |
| ***B22F 3/02*** | (2006.01) |
| ***B22F 3/24*** | (2006.01) |

(52) U.S. Cl.

CPC ..... *F42B 33/001* (2013.01); *B22F 3/02* (2013.01); *B22F 3/24* (2013.01); *B22F 2003/242* (2013.01); *B22F 2003/248* (2013.01); *B22F 2301/10* (2013.01); *B22F 2301/20* (2013.01); *B22F 2301/30* (2013.01)

(58) Field of Classification Search

None

See application file for complete search history.

(56) References Cited

U.S. PATENT DOCUMENTS

| | | | | |
|---|---|---|---|---|
| 627,929 | A | 6/1899 | Andrews et al. | |
| 3,132,591 | A | 5/1964 | Reinhold et al. | |
| 4,128,060 | A | 12/1978 | Gawlick et al. | |
| 5,275,110 | A | 1/1994 | Flatau | |
| 5,950,063 | A | 9/1999 | Hens et al. | |
| 6,048,379 | A | 4/2000 | Bray et al. | |
| 6,360,667 | B1 | 3/2002 | Nisimura | |
| 6,457,417 | B1 | 10/2002 | Beal | |
| 6,551,376 | B1 | 4/2003 | Beal | |
| 6,607,692 | B2 | 8/2003 | Beal | |
| 6,649,095 | B2 | 11/2003 | Buja | |
| 6,935,217 | B2 | 8/2005 | Beal | |
| 7,059,233 | B2 * | 6/2006 | Amick | F42B 12/74 102/517 |
| 7,069,834 | B2 | 7/2006 | Beal | |
| 7,204,191 | B2 | 4/2007 | Wiley et al. | |
| 7,232,473 | B2 | 6/2007 | Elliott | |
| 7,243,588 | B2 | 7/2007 | Beal | |
| 7,383,776 | B2 | 6/2008 | Amick | |
| 7,585,166 | B2 | 9/2009 | Buja | |

(Continued)

FOREIGN PATENT DOCUMENTS

| | | | |
|---|---|---|---|
| DE | 3840165 | A1 | 7/1990 |
| DE | 10045009 | A1 | 5/2001 |

(Continued)

*Primary Examiner* — Reginald S Tillman, Jr.

(74) *Attorney, Agent, or Firm* — BURDICK PATENTS, P.A.; Sean D. Burdick; Colin L. Honan

(57) ABSTRACT

A method of forming a projectile for use in a firearm ammunition cartridge, the method including mixing a first material and a second material having different densities to produce a core mixture, disposing the core mixture in a die, heating the core mixture to the melting point, removing the core mixture from the die, quenching the core mixture, and plating the core mixture with a jacket material.

16 Claims, 1 Drawing Sheet

(56) References Cited

U.S. PATENT DOCUMENTS

| | | | |
|---|---|---|---|
| 7,597,037 | B2 | 10/2009 | Beal |
| 7,750,091 | B2 | 7/2010 | Maljkovic et al. |
| 8,881,654 | B2 | 11/2014 | Seecamp |
| 11,268,791 | B1 | 3/2022 | Frees et al. |
| 2002/0056397 | A1 | 5/2002 | Carr et al. |
| 2002/0084543 | A1 | 7/2002 | Buja |
| 2005/0005807 | A1 | 1/2005 | Wiley et al. |
| 2006/0027129 | A1 | 2/2006 | Kolb et al. |
| 2008/0196616 | A1 | 8/2008 | Cziglenyi |
| 2009/0042057 | A1 | 2/2009 | Thomas et al. |
| 2013/0092041 | A1 | 4/2013 | Seecamp |
| 2018/0313639 | A1 | 11/2018 | Peterson |
| 2019/0277610 | A1 | 9/2019 | Eberhart |
| 2021/0341276 | A1 | 11/2021 | Jones |

FOREIGN PATENT DOCUMENTS

| | | | |
|---|---|---|---|
| EP | 2498046 | A1 | 9/2012 |
| GB | 2602050 | A | 6/2022 |
| WO | 2009111654 | A1 | 9/2009 |
| WO | 2018218292 | A1 | 12/2018 |

* cited by examiner

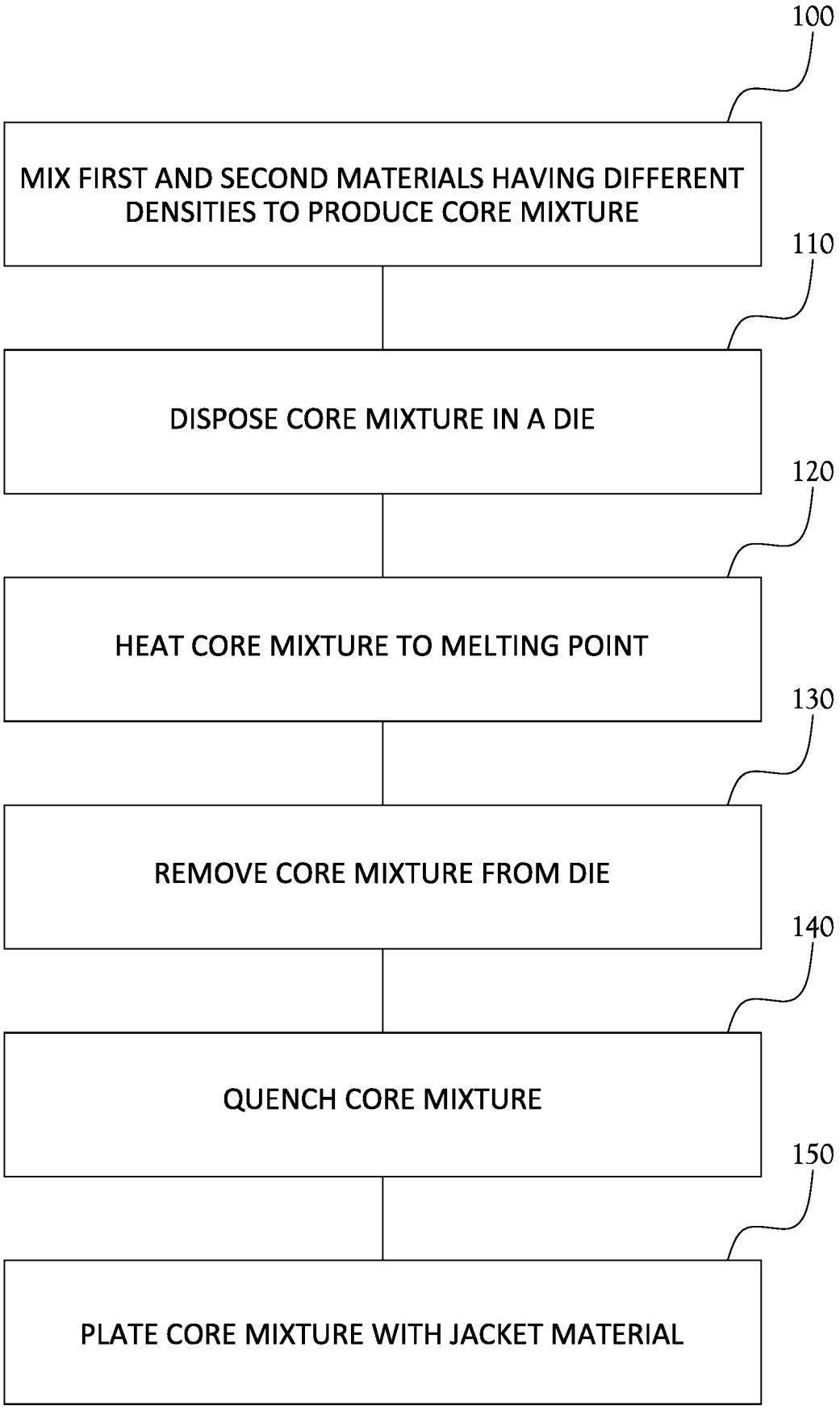
100
MIX FIRST AND SECOND MATERIALS HAVING DIFFERENT DENSITIES TO PRODUCE CORE MIXTURE
110
DISPOSE CORE MIXTURE IN A DIE
120
HEAT CORE MIXTURE TO MELTING POINT
130
REMOVE CORE MIXTURE FROM DIE
140
QUENCH CORE MIXTURE
150
PLATE CORE MIXTURE WITH JACKET MATERIAL

METHOD OF PRODUCING PLATED POWDER-CORE PROJECTILE

CROSS-REFERENCE TO RELATED APPLICATIONS

Not applicable.

FIELD OF INVENTION

The present general inventive concept relates to firearm ammunition and methods of manufacture thereof, and, more particularly, to method of producing an improved powder core projectile for a firearm ammunition cartridge.

BACKGROUND

Ammunition cartridges of the type commonly used in modern firearms are generally known in the art. An ammunition cartridge typically includes a generally cylindrical case which is sized and shaped to correspond to the interior of a firing chamber of a firearm. The case includes an open leading end having a projectile held therein. When the cartridge is received within the chamber, the leading end of the case carrying the projectile faces toward and along the bore of the firearm.

Lead, compacted metal powders, etc., are typically loaded into a jacket, such as a cup-shaped copper metal jacket. The core in the jacket is seated against the closed end of the jacket ("core seating"), and the open end of the jacket is formed about the core and shaped to define an aerodynamically desirable leading end of the projectile. For purposes of at least partially closing the open end of the jacket while defining the desired aerodynamic shape on that end of the core/jacket combination which will become the leading end of the projectile when it is fired from a gun, the core is chosen to be shorter in length than the depth of the jacket so that there is a portion of the jacket wall adjacent the open end of the jacket which is void of core material when the seating operation has been completed.

Core seating may take place with the core/jacket combination being held in a die while pressure is applied axially of the core to seat the core within the closed end of the jacket, and, in part, to the side wall of the jacket. Thereafter, and usually in a different die, the open end of the jacket is formed inwardly toward the longitudinal centerline of the jacket. This operation may take place in steps, and may involve more than one die, but in the end, the initially open end of the jacket is closed to the extend desired. The initially open end of the jacket may be fully closed or partially closed, in part depending upon the desired terminal ballistics of the projectile.

In certain projectiles, it may be desired that the projectile substantially disintegrate upon striking a target, often disintegrating only after limited penetration into a target. Maximum disintegration in these projectiles is desired, including maximum disintegration of the jacket into very small fragments, and disintegration of the powder-based core into particulates which are on the order of the individual particle size of the powder employed in forming the core. However, the forming of the powder core projectiles can be problematic, as a significant amount of the powder material may be loosened and separated from the core during production and plating. In some cases, as much as 5-7% of the core powder has been lost, which leaves openings for plating material to seep into the powder core during plating, which leads to cracks and corrosion in the plating jacket of the projectile.

This can have an ill effect on the general quality of the round, influencing numerous flight characteristics and projectile performance in the firearm itself. Thus, there is a desire for a method of making a higher quality powder core projectile to avoid these and other problems.

BRIEF SUMMARY

According to various example embodiments of the present general inventive concept, a method of forming a projectile is provided that includes melding powder materials having different densities to produce a centered powder core projectile.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a method of forming a projectile for use in a firearm ammunition cartridge, the method including mixing a first material and a second material having different densities to produce a core mixture, disposing the core mixture in a die, heating the core mixture to the melting point, removing the core mixture from the die, quenching the core mixture, and plating the core mixture with a jacket material. The quenching of the core mixture may include quenching with air. The first material may be tungsten, and the second material may be tin. The method may further include heating the core mixture to approximately 232 degrees Celsius. The first material may be a powder with a density higher than lead powder, and the second material may be a powder with a density lower than lead powder. The first material may be a lead powder. The method may further include mixing a binding material into the first and second materials. The binding material may include ACUMIST® A12. The core mixture may be compressed into a die that is undersized for a desired projectile size. The undersized die may be undersized by 1 to 10 thousandths of the desired projectile size. The core mixture may be heated in a laboratory oven. The jacket material may include copper. The method may further include re-striking the projectile after the plating of the core mixture to form the projectile in a desired projectile size. The re-striking of the projectile may include punching the projectile in a die.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which:

FIG. 1 illustrates a method of producing a firearm projectile according to an example embodiment of the present general inventive concept.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a method is provided to produce a centered powder core projectile which minimizes loss of core materials that affect plating and overall quality of the projectile. The various melding operations described herein help the grains of powder of the powder core bond together to better inhibit loss of the material.

FIG. 1 illustrates a method of producing a firearm projectile according to an example embodiment of the present general inventive concept. It is understood that the flow chart illustrating this method is simply one example embodiment of the present general inventive concept, and various other example embodiments may include more or fewer operations, and which may be performed in different orders and with various different components without departing from the scope of the present general inventive concept. In operation 100, a first material and a second material, such as, for example, first and second metal powders, having different densities are mixed together to produce the material for the projectile core, which may be referred to herein as the core mixture. In various example embodiments, the first material may be tungsten, and the second material may be tin. In various other example embodiments, the first and second materials may include a host of other elements. An example embodiment may include a first material with a density higher than lead powder, and a second material with a density lower than lead powder. Another example embodiment may include lead powder as one of the materials. In some example embodiments a binding material, such as, for example, ACUMIST® A12, may be added to the core mixture.

In operation 110, the core mixture is disposed in a die to be compressed. In various example embodiments a green compact may be formed with the compressed mixture. The core mixture may be compressed into a die that is undersized for a desired projectile size. For example, the die may be undersized by 1 to 10 thousandths of the desired projectile size. In operation 120, the core mixture is heated to the melting point, which may, for example, indicate the highest temperature before the core mixture melts, to produce a melded, or centered, core mixture. In various example embodiments the die may be placed in a laboratory oven for this heating. In an example embodiment in which the core mixture includes tungsten and tin, the core mixture may be heated to approximately 232 degrees Celsius. After being heated to the melting point for the core mixture, in operation 130 the die is removed from the heat and the core mixture removed from the die. In operation 140, the core mixture is quenched, which may include being air quenched. The quenching of the core mixture helps to seal the exterior surface, and to prevent plating fluids from being absorbed in the plating process. After this quenching operation, in operation 150 the core mixture is plated with a desired jacket material, which may include, for example, copper. In various example embodiments the projectile may be subjected to a re-striking operation after the core mixture is plated to form the projectile in a desired projectile size. The re-striking operation may include punching the projectile in a die, such as a 355 die.

The melding operation of the present general inventive concept produces a core mixture that is less prone to loss of core mixture material before and during the plating of the core mixture, so as to produce a more reliable and better quality firearm powder core projectile.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A method of forming a projectile for use in a firearm ammunition cartridge, the method comprising:

mixing a first material and a second material having different densities to produce a core mixture;

disposing the core mixture in a die;

heating the core mixture to a common melting point of the core mixture;

removing the core mixture from the die;

quenching the core mixture; and plating the core mixture with a jacket material.

2. The method of claim 1, wherein the quenching of the core mixture comprises quenching with air.

3. The method of claim 1, wherein the first material is tungsten, and the second material is tin.

4. The method of claim 3, further comprising heating the core mixture to approximately 232 degrees Celsius.

5. The method of claim 1, wherein the first material is a powder with a density higher than lead powder, and the second material is a powder with a density lower than lead powder.

6. The method of claim 1, wherein the first material is a lead powder.

7. The method of claim 1, further comprising mixing a binding material into the first and second materials.

8. The method of claim 7, wherein the binding material is a micronized high density oxidized polyethylene homopolymer.

9. The method of claim 1, wherein the core mixture is compressed into a die that is undersized for a desired projectile size.

10. The method of claim 9, wherein the undersized die is undersized by 1 to 10 thousandths of the desired projectile size.

11. The method of claim 1, wherein the core mixture is heated in a laboratory oven.

12. The method of claim 1, wherein the jacket material comprises copper.

13. The method of claim 1, further comprising re-striking the projectile after the plating of the core mixture to form the projectile in a desired projectile size.

14. The method of claim 13, wherein the re-striking of the projectile comprises punching the projectile in a die.

15. A method of forming a projectile for use in a firearm ammunition cartridge, the method comprising:

mixing a lead powder and a second material to produce a core mixture, the second material having a different density than lead;

disposing the core mixture in a die;

heating the core mixture to a melting point;

removing the core mixture from the die;

quenching the core mixture; and plating the core mixture with a jacket material.

16. The method of claim 15, wherein the second material has a density greater than lead.

* * * * *